US007452145B2

(12) United States Patent
Kato

(10) Patent No.: US 7,452,145 B2
(45) Date of Patent: Nov. 18, 2008

(54) HINGE STRUCTURE FOR PAPER CONTAINER IN A PRINTER

(75) Inventor: Hisahiro Kato, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 512 days.

(21) Appl. No.: 11/155,761

(22) Filed: Jun. 20, 2005

(65) Prior Publication Data

US 2005/0281607 A1 Dec. 22, 2005

(30) Foreign Application Priority Data

Jun. 18, 2004 (JP) ..... 2004-181323

(51) Int. Cl.
*B41J 29/02* (2006.01)
*E05D 7/00* (2006.01)

(52) U.S. Cl. ..... 400/693; 16/262; 16/267; 16/375; 16/380

(58) Field of Classification Search ..... None
See application file for complete search history.

(56) References Cited

U.S. PATENT DOCUMENTS 1,392,561 A * 10/1921 Duffy ..... 403/146
4,663,803 A * 5/1987 Gora ..... 16/266
5,135,318 A * 8/1992 Hongo ..... 400/621
5,361,456 A * 11/1994 Newby, Sr. ..... 16/260
5,790,162 A * 8/1998 Adams et al. ..... 400/693
6,089,487 A * 7/2000 Imai et al. ..... 400/244
6,315,154 B1 * 11/2001 Newby, Sr. ..... 16/380
2002/0131805 A1 * 9/2002 Sreekumar et al. ..... 400/719

FOREIGN PATENT DOCUMENTS

JP 05-059864 A 3/1993
JP 2000-073643 A 3/2000

* cited by examiner

*Primary Examiner*—Jill E. Culler
(74) *Attorney, Agent, or Firm*—Crowell & Moring LLP

(57) ABSTRACT

In a printer comprising a paper container for containing a recording paper, the paper container has a base member mounted of a housing of the printer and a cover member rotatably pivoted on the base member via a pair of hinge structures. Each hinge structure has at least a first bearing portion formed on the cover member and having a first center hole, at least a second bearing portion formed on the base member and having a second center, a hinge pin inserted into the first center hole of the first bearing portion and the second center hole of the second bearing portion, a first and a second stoppers formed on the base member for facing both ends of the hinge pin with predetermined gaps. The second stopper has elasticity to be deformed when the hinge pin is inserted into the first and second center holes by applying a pressure thereto and to be recovered to a natural shape when the pressure is released so as to prevent escape of the hinge pin from the first and second center holes.

10 Claims, 4 Drawing Sheets

HINGE STRUCTURE FOR PAPER CONTAINER IN A PRINTER

BACKGROUND OF THE INVENTION

1. Field of the Invention

The present invention relates to a printer for forming an image on a paper sheet such as a thermal recording paper which is colored by heat.

2. Description of the Related Art

In a field of a printer forming an image on a paper sheet, a thermal recording paper which is colored by heat is conventionally used. In a printer using the thermal recording paper, the thermal recording paper is generally contained in an airtight paper container, since the thermal recording paper has a behavior easily be deteriorated by humidity. The paper container is generally comprised of a base member mounted on a housing of a printer and a cover member rotatably pivoted by a pair of hinges on the base member. The thermal recording paper is contained in an inner space formed by the base member and the cover member as a roll.

As for the hinges of the conventional paper container, a pair of bearing portions each having a horizontal center hole is formed on one of the base member or the cover member, a pair of or two pairs of bearing portions is or are formed on the other of the base member or the cover member, and a pair of hinge pins serving as rotation shafts of the hinge structures is provided for penetrating through the center holes of the bearing portions. For preventing the escape of the hinge pins from the center holes of the bearing portions, independent members such as E-shaped rings are used. The E-shaped ring, however, is generally difficult to be engaged with the hinge pins, since a working space between the base member and the cover member is narrower. In other words, the conventional hinge structure of the conventional paper container is designed regardless of the assemble workability.

With respect to the hinge structure of the container, Japanese Laid-Open Patent Application No. 2000-73643 shows that a hook with a guide slit and an engaging protrusion is integrally formed on an end of a hinge pin, and a flange engaged with the guide slit and engaging recesses engaged with the engaging protrusion are formed on an outer face in the vicinity of the hinge. When the hinge pin is inserted into center holes of bearing portions of the hinge, the guide slit is engaged with the flange and the engaging protrusion is engaged with one of the engaging recesses, so that it is possible to prevent the escape of the hinge pin.

Furthermore, Japanese Laid-Open Patent Application No. 5-59864 shows a hinge pin having a larger diameter portion adjoining to a portion to be inserted into center holes of bearing portions of a hinge, and a stopper is formed to be contacted with the larger diameter portion, so that it is possible to prevent the escape of the hinge pin.

SUMMARY OF THE INVENTION

A purpose of the present invention is to provide a hinge structure of a container and a printer having the hinge structure of a paper container, by which the hinge can easily be assembled and the escape of the hinge pin can be prevented without using independent member such as an E-shaped ring.

A hinge structure of a container for rotatably pivoting a cover member on a base member in accordance with an aspect of the present invention comprises: at least a first bearing portion formed on the cover member and having a first center hole; at least a second bearing portion formed on the base member and having a second center hole of substantially the same diameter of the first center hole; a hinge pin inserted into the first center hole of the first bearing portion and the second center hole of the second bearing portion for aligning said at least a first bearing portion and said at least a second bearing portion on a same axis so that the cover member is rotatably pivoted on the base member; a first stopper formed at a first position on the base member or the cover member for facing an end of the hinge pin with a predetermined gap; and a second stopper formed at a second position on the base member or the cover member so that a part of the second stopper faces another end of the hinge pin with a predetermined gap in a natural shape, and having elasticity to be deformed when the hinge pin is inserted into the first center hole of the first bearing portion and the second center hole of the second bearing portion by applying a pressure thereto and to be recovered to the natural shape when the pressure is released so as to prevent escape of the hinge pin from the first center hole of the first bearing portion and the second center hole of the second bearing portion.

A printer in accordance with an aspect of the present invention comprises a paper container for containing a recording paper, a paper feeding mechanism for feeding the recording paper along a predetermined path, a recording head provided at a position facing the predetermined path and for forming an image on the recording paper, and a housing for containing the paper feeding mechanism and the recording head and on which the paper container is held. The paper container has a base member mounted on the housing and a cover member rotatably pivoted on the base member via an at least a hinge structure mentioned above.

By such configurations, when the hinge pin is once inserted into the first center hole of the first bearing portion and the second center hole of the second center hole, the first and second stoppers face both ends of the hinge pin with predetermined gaps. Since the hinge pin can move only in the gaps in axial direction thereof, it is possible to prevent the escape of the hinge pin from the first and second center holes.

It is possible that the second stopper serves as a plate spring integrally formed with the first member or the second member.

DETAILED DESCRIPTION OF THE EMBODIMENT

Figure 1:
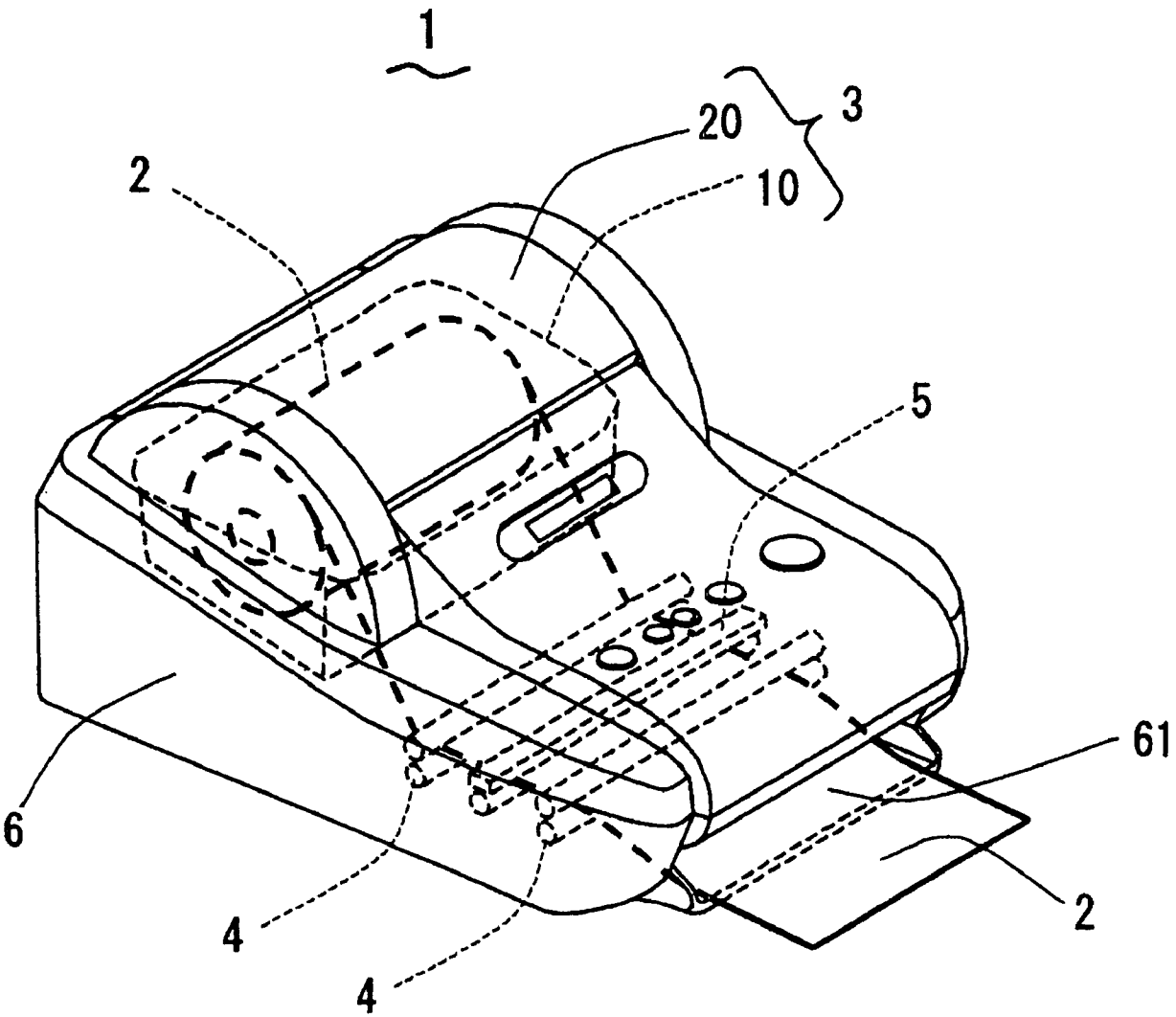
FIG. 1 is a perspective view showing a configuration of a printer in accordance with an embodiment of the present invention.

A hinge structure of a container and a printer using the same in accordance with an embodiment of the present invention are described with reference to the figures. FIG. 1 shows a configuration of a printer 1 in the embodiment. The printer 1 forms an image on a thermal recording paper 2 with using an image data inputted from, for example, a digital still camera or a personal computer.

The printer 1 comprises a paper container 3 for containing the thermal recording paper 2 as a roll, a paper feeding mechanism 4 for feeding the thermal recording paper 2, a thermal recording head 5 used for forming an image on the thermal recording paper 2 by applying heat selectively, and a housing 6 including the paper feeding mechanism 4 and the thermal head 5, and holding the paper container 3.

The thermal recording paper 2 is colored by heat, and wound around a tubular core as a roll. The paper container 3 comprises a base member 10 mounted on the housing 6 and a cover member 20 rotatably pivoted of the base member by a pair of hinge structures for opening and closing an inner space of the paper container 3. The roll of the thermal recording paper 2 is contained in the inner space of the paper container 3. A reel out mechanism (not shown) is further provided in the inside of the paper container 3 for reeling out an end portion of the roll of the thermal recording paper 2 to the paper feeding mechanism 4 provided in an inside of the housing 6. The paper feeding mechanism 4 reciprocally moves the thermal recording paper 2 in longitudinal direction thereof with respect to the thermal recording head 5 for forming a color image on the thermal recording paper 2. The thermal recording head 5 has an array of minute heat generating devices arranged in a width direction of the thermal recording paper 2 (or a direction perpendicular to the feeding direction of the thermal recording paper 2). The minute heat generating devices are controlled for heating or not heating with using an image data inputted from a digital still camera or a personal computer.

The printer 1 further comprises a cutter (not shown) for cutting the thermal recording paper 2 by a predetermined length, which is provided at a position downstream side of the thermal recording head 5 in a feeding path of the paper feeding mechanism 4. The paper feeding mechanism 4 further carries the cut paper sheet of the thermal recording paper on which an image is formed from an opening 61 of the housing 6. In such a printer 1, it is possible to print an image with a photographic frame such as a normal frame, a panorama frame, and so on.

Figure 2:
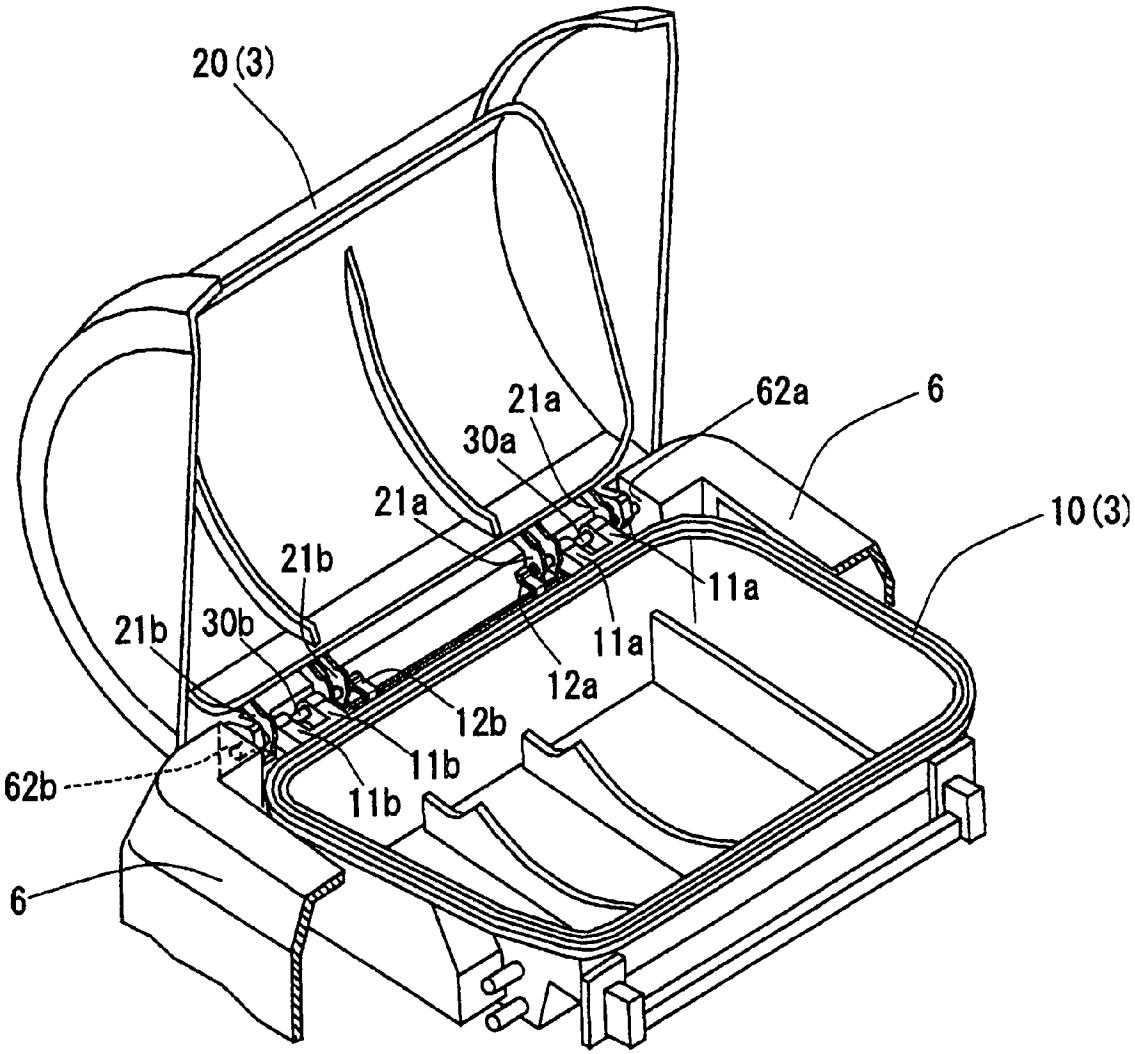
FIG. 2 is a perspective view showing a configuration of a paper container of the printer.

FIG. 2 shows a configuration of the paper container 3. In FIG. 2, illustration of the roll of the thermal recording paper 2 and the reel out mechanism of the thermal recording paper 2 is omitted. As mentioned above, the paper container 3 comprises the base member 10 and the cover member 20 rotatably pivoted on the base member 10 by the hinges. The base member 10 is fixed on the housing 6 by, for example, screws. The cover member 20 is coupled with the base member 10 via hinge pins 30*a* and 30*b* so that the cover member 20 is, rotatably pivoted on the cover member 10.

The base member 10 has two pairs of bearing portions 11*a* and 11*b* each having a center hole to which the hinge pins 30*a* and 30*b* are inserted, and a pair of stoppers 12*a* and 12*b* used for preventing escape of the hinge pins 30*a* and 30*b* from the center holes of the bearing portions 11*a* and 11*b*. On the other hand, the cover member 20 has four pairs of bearing portions 21*a* and 21*b* to which the hinge pins 30*a* and 30*b* are inserted. The housing 6 has a pair of stoppers 62*a* and 62*b* facing an end of the hinge pins 30*a* and 30*b* for preventing the escape of the hinge pins 30*a* and 30*b* from the center holes of the bearing portions 11*a*, 11*b*, 21*a* and 21*b*.

Detailed configuration of the hinges of the paper container 3 is described with reference to FIGS. 3A, 3B, 4A and 4B. The bearing portions 11*a* (and 11*b* not shown in these figures) are integrally formed with the base member 10 by resin molding. Each bearing portion 11*a* (or 11*b*) has a horizontal center hole 19*a* to which the bearing pin 30*a* or 30*b* is inserted. Similarly, the bearing portions 21*a* (and 21*b*) are integrally formed with the cover member 20 by resin molding. Each bearing portion 21*a* (or 21*b*) has a horizontal center hole 29*a* to which the bearing pin 30*a* (or 30*b*) is inserted. The hinge pins 30*a* (and 30*b*) are cylindrical and made of, for example, a metal material such as a stainless steel. A diameter of the hinge pins 30*a* (and 30*b*) is a little smaller than the diameter of the center holes 19*a* and 29*a* of the bearing portions 11*a* (and 11*b*) and 21*a* (and 21*b*). A length of the hinge pins 30*a* (and 30*b*) is a little shorter than a distance between the stoppers 12*a* and the 62*a* (and 12*b* and 62*b*).

The stoppers 12*a* (and 12*b*) are fixed on the base member 10 via a holder 13. The stoppers 12*a* (and 12*b*) have a substantially L-shaped section as a natural shape, made of an elastic material such as a resin so that a rear anchor 121 is integrally formed with the holder 13 and a portion near to the front end 122 serves as a plate spring or a cantilever. As shown in FIG. 3B, when no external force is applied to the stopper 12*a* (or 12*b*), the front end 122 of the stopper 12*a* (or 12*b*) is located at a natural position overlapping the center holes 19*a* of the bearing portion 11*a* (or 11*b*) in the vertical direction by elasticity of the material of the stopper 12*a* (or 12*b*).

Figure 3A:
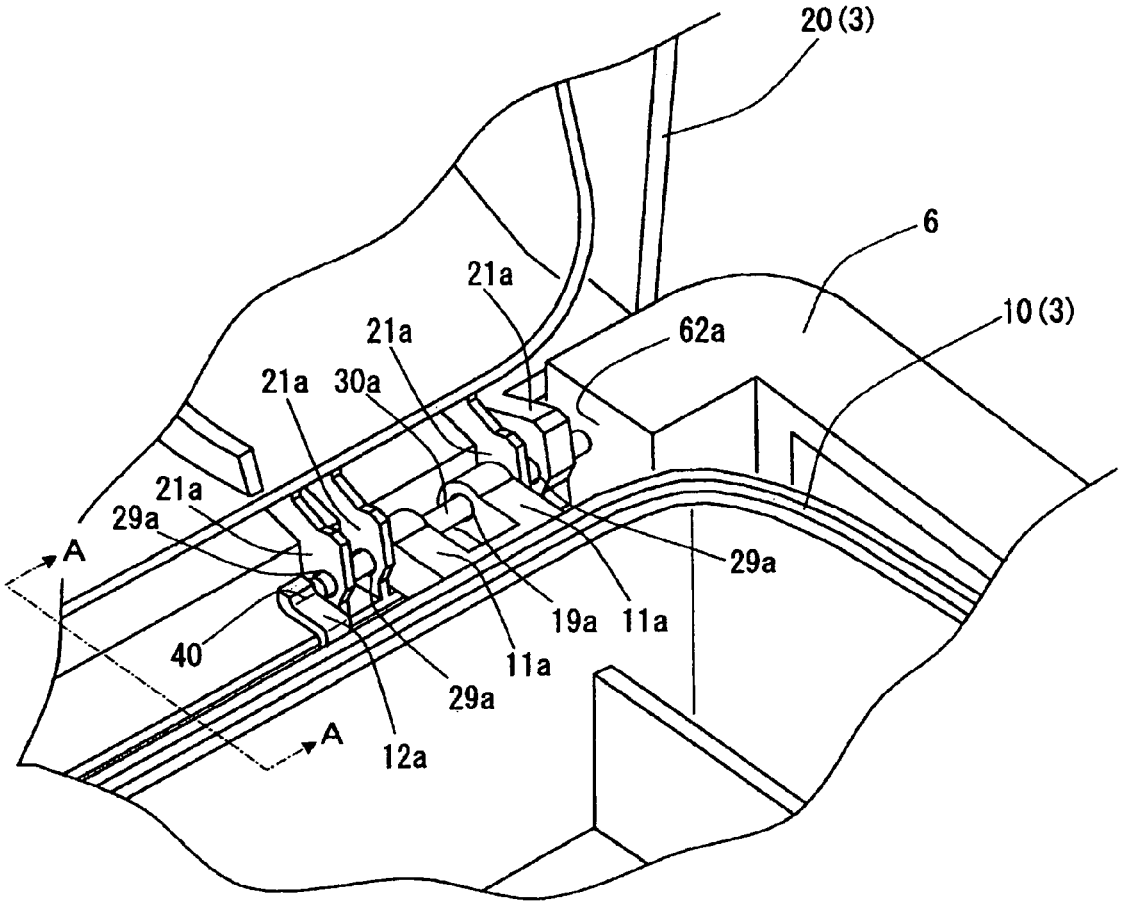
FIG. 3A is an enlarged perspective view showing a configuration of a department of a hinge of the paper container after insertion of a hinge pin.
Figure 3B:
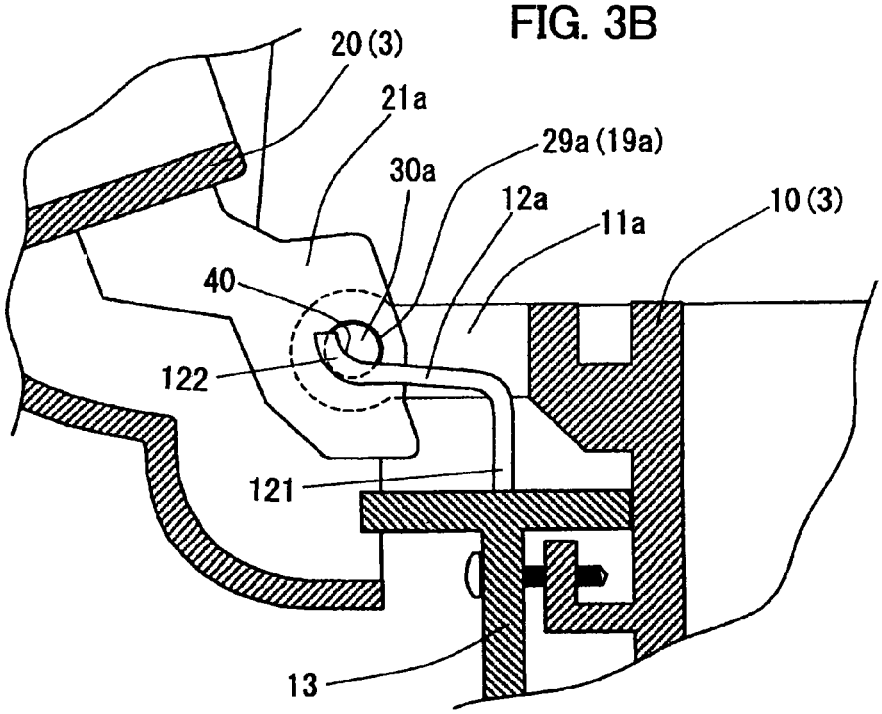
FIG. 3B is an A-A sectional view of FIG. 3A.

FIGS. 3A and 3B show a state that the hinge pin 30*a* (or 30*b*) is fully inserted into the center holes 19*a* and 29*a* of the bearing portions 11*a* (or 11*b*) and 21*a* (or 21*b*). When the hinge pin 30*a* (or 30*b*) is fully inserted into the center holes 19*a* and 29*a* of the bearing portions 11*a* (or 11*b*) and 21*a* (or 21*b*), the stopper 12*a* (or 12*b*) takes the natural shape, so that the front end 122 is located for facing an end of the hinge pin 30*a* (or 30*b*) in an axial direction of the hinge pin 30*a* (or 30*b*). Thus, the position of the hinge pin 30*a* (or 30*b*) is restricted between the stoppers 12*a* and 62*a* (or 12*b* and 62*b*). Even when an external force is applied to the hinge pin 30*a* (or 30*b*) in the axial direction thereof, the motion of the hinge pin 30*a* (or 30*b*) is restricted in a gaps between both ends of the hinge pin 30*a* (or 30*b*) and the stoppers 12*a* and 62*a* by contacting with the stopper 12*a* or 62*a* (or 12*b* or 62*b*). Thus, the escape of the hinge pin 30*a* (or 30*b*) can be prevented.

Figure 4A:
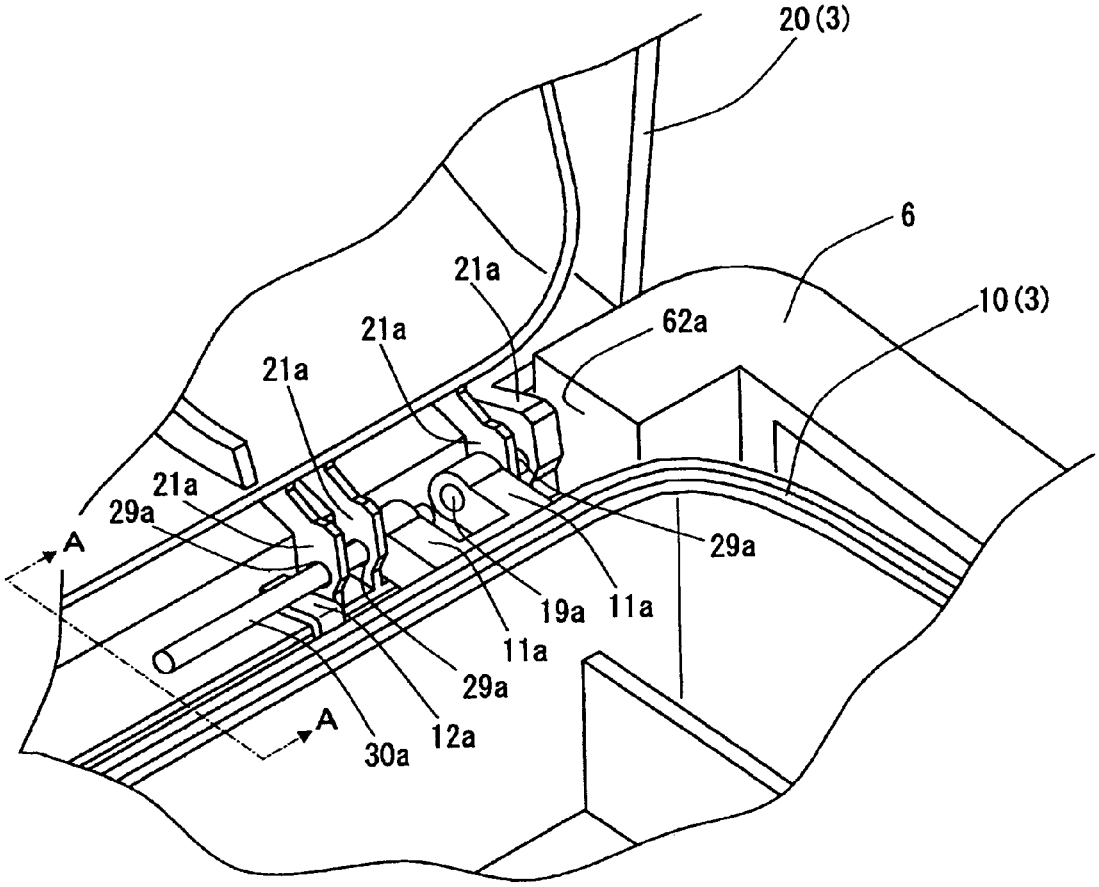
FIG. 4A is an enlarged perspective view showing a configuration of the department of the hinge while the hinge pin is inserted to center holes of bearing portions of the hinge.
Figure 4B:
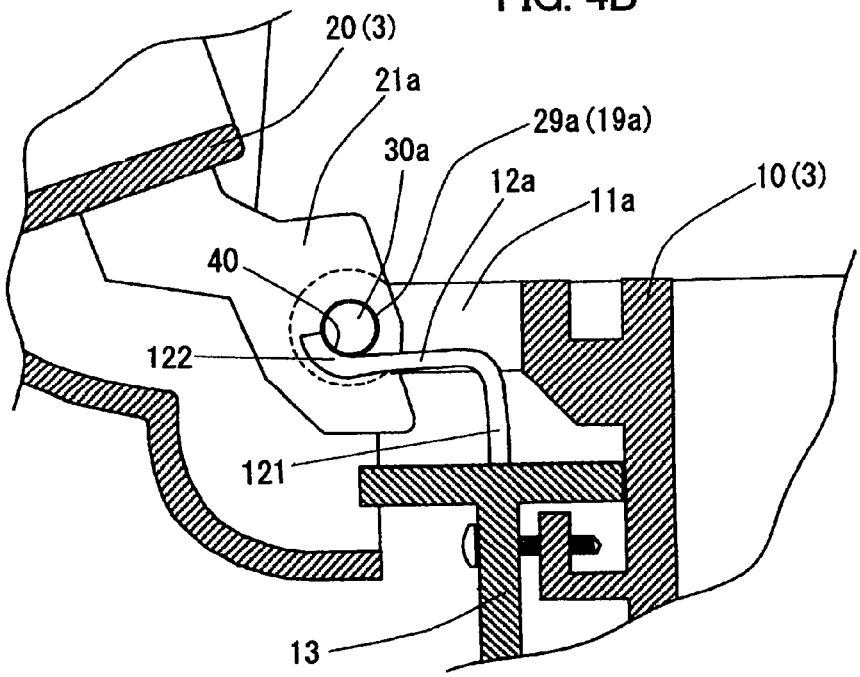
FIG. 4B is an A-A sectional view of FIG. 4A.

FIGS. 4A and 4B shows a state that the hinge pin 30*a* (or 30*b*) is in mid-way to be inserted into or pulled out from the center holes 19*a* and 29*a* of the bearing portions 11*a* (or 11*b*) and 21*a* (or 21*b*). A circularly bent guide face 40, on which the hinge pins 30*a* (and 30*b*) can be disposed, is formed at the front end 122 of the stoppers 12*a* (and 12*b*), and the front end 122 of the stoppers 12*a* (and 12*b*) can be warped by the elasticity in a plane perpendicular to the center axis of the hinge pins 30*a* (and 30*b*). Thus, the hinge pins 30*a* (and 30*b*) can be inserted into or pulled out from the center holes 19*a* and 29*a* of the bearing portions 11*a* and 21*a* (and 11*b* and 21*b*) while the front end 122 of the stoppers 12*a* (and 12*b*) are warped to be lower than the center holes 19*a* and 29*a* in the vertical direction, as shown in FIGS. 4A and 4B.

Assembling of the paper container 3 is described. First, the base member 10 is fixed on the housing 6 by screws. Subsequently, the cover member 20 is held that the center holes 29*a* of the bearing portions 21*a* (and 21*b*) of the cover member 20 coincide with the center holes 19*a* of the bearing portions 11*a* (and 11*b*) of the base member 10. Under such a state, the hinge pin 30*a* (or 30*b*) is disposed on the guide face 40 of the stopper 12*a* (or 12*b*) with a pressure for warping the front end. 122 of the stopper 12*a* (or 12*b*). The hinge pin 30*a* (or 30*b*) is further pushed in the axial direction thereof toward the center holes 19*a* and 29*a* of the bearing portions 11*a* and 21*a* (or 11*b* and 21*b*). When the center axis of the hinge pin 30*a* (or 30*b*) coincides with the axis of the center holes 19*a* and 29*a* of the bearing portions 11*a* and 21*a* (or 11*b* and 21*b*), the hinge pin 30*a* (or 30*b*) proceeds into the center holes 19*a* and 29*a* of the bearing portions 11*a* and 21*a* (or 11*b* and 21*b*). When the hinge pin 30*a* (or 30*b*) is completely inserted into the center holes 19*a* and 29*a* of the bearing portions 11*a* and 21*a* (or 11*b* and 21*b*), the hinge pin 30*a* (or 30*b*) detaches from the guide face 40 of the stopper 12*a* (or 12*b*), and the pressure for warping the front end 122 of the stopper 12*a* (or 12*b*) is released. Thus, the front end 122 of the stopper 12*a* (or 12*b*) returns to the natural position, so that the escape of the hinge pin 30*a* (or 30*b*) can be prevented. The other hinge pin 30*b* (or 30*a*) is inserted into the center holes 19*a* and 29*a* of the bearing portions 11*b* and 21*b* (or 11*a* and 21*a*) in the same manner. Consequently, the paper container 3 can be assembled.

In the assembled paper container 3, the cover member 20 is rotatably pivoted around the hinge pins 30*a* and 30*b* on the base member 10 by a pair of hinges which are comprised of the hinge pins 30*a* and 30*b*, and bearing portions 11*a*, 11*b*, 21*a* and 21*b*. Furthermore, the escape of the hinge pin 30*a* or 30*b* is prevented by the stoppers 12*a* and 62*a* or 12*b* and 62*b*.

For disassembling the paper container 3, the stoppers 12*a* and 12*b* are forcible warped so that the front end 122 of the stoppers 12*a* and 12*b* is located below the center hole 19*a* and 29*a* of the bearing portions 11*a*, 11*b*, 21*a* and 21*b* by applying a pressure, and the hinge pins 30*a* and 30*b* are pulled out from the center hole 19*a* and 29*a* of the bearing portions 11*a*, 11*b*, 21*a* and 21*b*. Simultaneously, the cover member 20 is disengaged from the base member 10. After that, the base member 10 is removed from the housing 6. Since the stoppers 12*a* and 12*b* has elasticity, it is possible to repeat the assembling and disassembling of the paper container 3.

According to the above-mentioned hinge structure and the printer 1 using the same, the hinge pins 30*a* and 30*b* can easily be inserted into the center holes 19*a* and 29*a* of the bearing portions 11*a*, 11*b*, 21*a* and 21*b* while the front ends 122 of the stoppers 12*a* and 12*b* are warped by applying pressures thereto. Furthermore, when the pressure applied to the stoppers 12*a* and 12*b* are released, the escape of the hinge pins 30*a* and 30*b* can easily be prevented by recovering of the stoppers 12*a* and 12*b*. Similarly, the hinge pins 30*a* and 30*b* can easily be pulled out from the center holes 19*a* and 29*a* of the bearing portions 11*a*, 11*b*, 21*a* a and 21*b* while the front ends 122 of the stoppers 12*a* and 12*b* are warped by applying pressures thereto. Still furthermore, since the circularly bent guide face 40 is formed at the front end 122 of the stoppers 12*a* and 12*b*, the hinge pins 30*a* and 30*b* can easily be held on the guide face 40 while the assembling and disassembling of the paper container 3. Thus, the assembling and disassembling of the paper container 3 can easily be performed. Still furthermore, since the escape of the hinge pins 30*a* and 30*b* from the center holes 19*a* and 29*a* of the bearing portions 11*a*, 11*b*, 21*a* and 21*b* is prevented by the stoppers 12*a*, 12*b*, 62*a* and 62*b*, it possible to form the hinge pin 30*a* and 30*b* as cylindrical shape, simply. Thus, the cost of the hinge structure and the printer 1 using the same can be reduced.

The present invention is not limited to the above-mentioned description and illustration of the embodiment, and it is possible to modify to various manners. The shape of the stoppers 12*a* and 12*b* are not limited to have substantially L-shaped section or not limited to have a front free end. If the stopper 12*a* and 12*b* is deformable and recoverable by elasticity, the stoppers 12*a* and 12*b* can have an arbitrary shape. Furthermore, the stoppers 12*a* and 12*b* can directly be formed on the base member 10 without using the holder 13. Still furthermore, the guide face 40*a* is not necessarily formed at the front end 122 of the stoppers 12*a* and 12*b*. In case of forming the guide face 40, the shape of the guide face 40 is not limited to the circular. If the hinge pin 30*a* or 30*b* can be held, the guide face 40 can have an arbitrary shape.

Still furthermore, since the hinge structure is not limited to the paper container of the printer, it is applicable to any type of container having a cover member rotatably pivoted on a base member via at least one hinge structure. Still furthermore, the paper container is not limited to a type of containing a roll of the paper. It is possible to apply a paper container for containing bundle of cut sheets. Still furthermore, the kind of the paper contained in the paper container is not limited to the thermal recording paper. For example, when the printer is an inkjet type one for emitting ink on a paper sheet, natural paper can be contained in the paper container.

In summary, it is sufficient that a hinge structure of a container for rotatably pivoting a cover member on a base member comprises the following elements: at least a first bearing portion formed on the cover member and having a first center hole; at least a second bearing portion formed on the base member and having a second center hole of substantially the same diameter of the first center hole; a hinge pin inserted into the first center hole of the first bearing portion and the second center hole of the second bearing portion for aligning said at least a first bearing portion and said at least a second bearing portion on a same axis so that the cover member is rotatably pivoted on the base member; a first stopper formed at a first position on the base member or the cover member for facing an end of the hinge pin with a predetermined gap; and a second stopper formed at a second position on the base member or the cover member so that a part of the second stopper faces another end of the hinge pin with a predetermined gap in a natural shape, and having elasticity to be deformed when the hinge pin is inserted into the first center hole of the first bearing portion and the second center hole of the second bearing portion by applying a pressure thereto and to be recovered to the natural shape when the pressure is released so as to prevent escape of the hinge pin from the first center hole of the first bearing portion and the second center hole of the second bearing portion.

Furthermore, it is sufficient that the printer comprises a paper container for containing a recording paper, a paper feeding mechanism for feeding the recording paper along a predetermined path, a recording head provided at a position facing the predetermined path and for forming an image on the recording paper, and a housing for containing the paper feeding mechanism and the recording head and on which the paper container is held. The paper container has a base member mounted on the housing and a cover member rotatably pivoted on the base member via an at least a hinge structure mentioned above.

By such configurations, when the hinge pin is once inserted into the first center hole of the first bearing portion and the second center hole of the second center hole, the first and second stoppers face both ends of the hinge pin with predetermined gaps. Since the hinge pin can move only in the gaps in axial direction thereof, it is possible to prevent the escape of the hinge pin from the first and second center holes.

This application is based on Japanese patent application 2004-181323 filed Jun. 18, 2004 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A hinge structure of a container for rotatably pivoting a cover member on a base member comprising:

at least a first bearing portion provided on the cover member and having a first center hole;

at least a second bearing portion provided on the base member and having a second center hole of substantially the same diameter as the first center hole;

a hinge pin inserted into the first center hole of the first bearing portion and the second center hole of the second bearing portion for aligning said at least a first bearing portion and said at least a second bearing portion on a same axis so that the cover member is rotatably pivoted on the base member;

a first stopper provided at a first position on the base member or the cover member for facing an end of the hinge pin with a predetermined gap; and a second stopper provided at a second position on the base member or the cover member so that a part of the second stopper faces another end of the hinge pin with a predetermined gap in a natural shape, and having elasticity to be deformed when the hinge pin is inserted into the first center hole of the first bearing portion and the second center hole of the second bearing portion by applying a pressure thereto and to be recovered by displacement radially with respect to a longitudinal axis of the hinge pin to a natural shape when the pressure is released so as to prevent escape of the hinge pin from the first center hole of the first bearing portion and the second center hole of the second bearing portion.

2. A hinge structure of a container for rotatably pivoting a cover member on a base member comprising:

at least a first bearing portion formed on the cover member and having a first center hole;

at least a second bearing portion formed on the base member and having a second center hole of substantially the same diameter as the first center hole;

a hinge pin inserted into the first center hole of the first bearing portion and the second center hole of the second bearing portion for aligning said at least a first bearing portion and said at least a second bearing portion on a same axis so that the cover member is rotatably pivoted on the base member;

a first stopper formed at a first position on the base member or the cover member for facing an end of the hinge pin with a predetermined gap; and a second stopper formed at a second position on the base member or the cover member so that a part of the second stopper faces another end of the hinge pin with a predetermined gap in a natural shape, and having elasticity to be deformed when the hinge pin is inserted into the first center hole of the first bearing portion and the second center hole of the second bearing portion by applying a pressure thereto and to be recovered to a natural share when the pressure is released so as to prevent escape of the hinge pin from the first center hole of the first bearing portion and the second center hole of the second bearing portion, wherein the second stopper serves as a plate spring integrally formed with the base member or the cover member.

3. A hinge structure of a container for rotatably pivoting a cover member on a base member comprising:

at least a first bearing portion formed on the cover member and having a first center hole;

at least a second bearing portion formed on the base member and having a second center hole of substantially the same diameter as the first center hole;

a hinge pin inserted into the first center hole of the first bearing portion and the second center hole of the second bearing portion for aligning said at least a first bearing portion and said at least a second bearing portion on a same axis so that the cover member is rotatably pivoted on the base member;

a first stopper formed at a first position on the base member or the cover member for facing an end of the hinge pin with a predetermined gap; and a second stopper formed at a second position on the base member or the cover member so that a part of the second stopper faces another end of the hinge pin with a predetermined gap in a natural shape, and having elasticity to be deformed when the hinge pin is inserted into the first center hole of the first bearing portion and the second center hole of the second bearing portion by applying a pressure thereto and to be recovered to a natural shape when the pressure is released so as to prevent escape of the hinge pin from the first center hole of the first bearing portion and the second center hole of the second bearing portion, wherein a guide face for guiding insertion of the hinge pin into the first center hole of the first bearing portion and the second center hole of the second bearing portion is formed near to a front end of the second stopper.

4. The hinge structure in accordance with claim 3, wherein the hinge pin has a circular cylinder shape, and at least a part of the guide face is circularly bent.

5. A printer comprising a paper container for containing a recording paper, a paper feeding mechanism for feeding the recording paper along a predetermined path, a recording head provided at a position facing the predetermined path and for forming an image on the recording paper, and a housing for containing the paper feeding mechanism and the recording head and on which the paper container is held; wherein the paper container has a base member mounted on the housing and a cover member rotatably pivoted on the base member via a at least a hinge structure; and the hinge structure has;

at least a first bearing portion provided on the cover member and having a first center hole;

at least a second bearing portion provided on the base member and having a second center hole of substantially the same diameter as the first center hole;

a hinge pin inserted into the first center hole of the first bearing portion and the second center hole of the second bearing portion for aligning said at least a first bearing portion and said at least a second bearing portion on a same axis so that the cover member is rotatably pivoted on the base member;

a first stopper provided at a first position on the base member or the cover member for facing an end of the hinge pin with a predetermined gap; and a second stopper provided at a second position on the base member or the cover member so that a part of the second stopper faces another end of the hinge pin with a predetermined gap in a natural shape, and having elasticity to be deformed when the hinge pin is inserted into the first center hole of the first bearing portion and the second center hole of the second bearing portion by applying a pressure thereto and to be recovered by displacement radially with respect to a longitudinal axis of the hinge pin to a natural shape when the pressure is released so as to prevent escape of the hinge pin from the first center hole of the first bearing portion and the second center hole of the second bearing portion.

6. The printer in accordance claim 5, wherein the recording paper is a color thermal recording paper and contained in the paper container as a roll.

7. The printer in accordance with claim 6, wherein the paper container is airtight.

8. A printer comprising a paper container for containing a recording paper, a paper feeding mechanism for feeding the recording paper along a predetermined path, a recording head provided at a position facing the predetermined path and for forming an image on the recording paper, and a housing for containing the paper feeding mechanism and the recording head and on which the paper container is held; wherein the paper container has a base member mounted on the housing and a cover member rotatably pivoted on the base member via a at least a hinge structure; and the hinge structure has:

at least a first bearing portion formed on the cover member and having a first center hole;

at least a second bearing portion formed on the base member and having a second center hole of substantially the same diameter as the first center hole;

a hinge pin inserted into the first center hole of the first bearing portion and the second center hole of the second bearing portion for aligning said at least a first bearing portion and said at least a second bearing portion on a same axis so that the cover member is rotatably pivoted on the base member;

a first stopper formed at a first position on the base member or the cover member for facing an end of the hinge pin with a predetermined gap; and a second stopper formed at a second position on the base member or the cover member so that a part of the second stopper faces another end of the hinge pin with a predetermined gap in a natural shape, and having elasticity to be deformed when the hinge pin is inserted into the first center hole of the first bearing portion and the second center hole of the second bearing portion by applying a pressure thereto and to be recovered to a natural shape when the pressure is released so as to prevent escape of the hinge pin from the first center hole of the first bearing portion and the second center hole of the second bearing portion, wherein the second stopper serves as a plate spring integrally formed with the cover member or the base member.

9. A printer comprising a paper container for containing a recording paper, a paper feeding mechanism for feeding the recording paper alone a predetermined path, a recording head provided at a position facing the predetermined path and for forming an image on the recording Paper, and a housing for containing the paper feeding mechanism and the recording head and on which the paper container is held; wherein the paper container has a base member mounted on the housing and a cover member rotatably pivoted on the base member via a at least a hinge structure;

the hinge structure has:

at least a first bearing portion formed on the cover member and having a first center hole;

at least a second bearing portion formed on the base member and having a second center hole of substantially the same diameter as the first center hole;

a hinge pin inserted into the first center hole of the first bearing portion and the second center hole of the second bearing portion for aligning said at least a first bearing portion and said at least a second bearing portion on a same axis so that the cover member is rotatably pivoted on the base member;

a first stopper formed at a first position on the base member or the cover member for facing an end of the hinge pin with a predetermined gap; and a second stopper formed at a second position on the base member or the cover member so that a part of the second stopper faces another end of the hinge pin with a predetermined gap in a natural shape, and having elasticity to be deformed when the hinge pin is inserted into the first center hole of the first bearing portion and the second center hole of the second bearing portion by applying a pressure thereto and to be recovered to a natural shape when the pressure is released so as to prevent escape of the hinge pin from the first center hole of the first bearing portion and the second center hole of the second bearing portion; and a guide face for guiding insertion of the hinge pin into the first center hole of the first bearing portion and the second center hole of the second bearing portion is formed near to a front end of the second stopper.

10. The printer in accordance with claim 9, wherein the hinge pin has a circular cylinder shape, and at least a part of the guide face is circularly bent.

* * * * *